United States Patent [19]

Pintsov et al.

[11] Patent Number: 4,765,502

[45] Date of Patent: Aug. 23, 1988

[54] APPARATUS FOR NONSTOP OPERATION OF AN INSERTER SYSTEM WITH MULTIPLE DOCUMENT FEEDING CAPABILITY

[75] Inventors: Leon A. Pintsov, West Hartford; David R. Auerbach, Georgetown, both of Conn.

[73] Assignee: Pitney Bowes Inc., Stamford, Conn.

[21] Appl. No.: 64,024

[22] Filed: Jun. 19, 1987

[51] Int. Cl.[4] ..... B65H 5/30

[52] U.S. Cl. ..... 270/55; 271/288; 198/349

[58] Field of Search ..... 270/54–58, 270/53; 53/206, 266 A; 271/288, 69, 198–199, 259; 198/349

[56] References Cited

U.S. PATENT DOCUMENTS

| | | | |
|---|---|---|---|
| 3,059,391 | 10/1962 | Volks et al. | 270/55 |
| 3,726,168 | 4/1973 | Glanz et al. | 83/79 |
| 4,020,615 | 5/1977 | Irvine et al. | 53/266 A |
| 4,130,193 | 12/1978 | Bourgeois | 198/369 |
| 4,169,341 | 10/1979 | Roetter et al. | 53/266 A |
| 4,317,203 | 2/1982 | Botte et al. | 271/259 |
| 4,402,496 | 9/1983 | Muller | 270/55 |
| 4,446,962 | 5/1984 | Burkhardt | 271/314 X |
| 4,471,953 | 9/1984 | Reist et al. | 270/58 |
| 4,499,834 | 2/1985 | Ruetschle et al. | 270/53 |
| 4,500,083 | 2/1985 | Wong | 270/58 |
| 4,527,790 | 7/1985 | Piotroski | 270/58 |
| 4,541,764 | 9/1985 | Govan et al. | 414/52 |
| 4,544,146 | 10/1985 | Zemke et al. | 270/58 |
| 4,640,506 | 2/1987 | Luperti et al. | 271/212 |
| 4,676,495 | 6/1987 | Hughes | 270/58 |
| 4,682,767 | 7/1987 | Littleton | 270/58 X |
| 4,707,790 | 11/1987 | Gomet et al. | 53/266 A X |

*Primary Examiner*—Eugene H. Eickholt

*Attorney, Agent, or Firm*—Gerald E. Linden; David E. Pitchenik; Melvin J. Scolnick

[57] ABSTRACT

Continuous operation of the conveyor in an inserter system is achieved by providing a lift up station (LUS) between a Document Entry Device (DED) and the next downstream Multiple Document Entry Device (MDED). A controller causes the LUS to remove documents from the conveyor when it is determined that the time, $t_2$, required by the MDED to complete assembly of an enclosure for ejection onto the conveyor exceeds the time, $t_1$, required by the conveyor to move the document ejected by the DED to the MDED, and subsequently causes the LUS to replace the documents onto the conveyor at a time substantially $t_2-t_1$ later. Apparatus and method are disclosed.

5 Claims, 3 Drawing Sheets

APPARATUS FOR NONSTOP OPERATION OF AN INSERTER SYSTEM WITH MULTIPLE DOCUMENT FEEDING CAPABILITY

CROSS-REFERENCE TO RELATED APPLICATIONS

Reference is made to copending, commonly-owned U.S. Patent Application Ser. No. 930,216, titled COLLATING STATION FOR INSERTING MACHINE, and filed on Nov. 13, 1986 by Irvine and Luperti.

TECHNICAL FIELD OF THE INVENTION

The invention relates to methods and apparatus for assembling individual documents into collations of documents, such as for insertion of the collations into envelopes prior to mailing.

BACKGROUND OF THE INVENTION

A typical inserter system comprises a document transport unit (hereinafter "conveyor") for transporting documents, a plurality of document entry devices disposed along the conveyor for ejecting documents onto the conveyor, usually an envelope module for introducing an envelope to the conveyor and inserting collations of documents into the envelope, and a controller for exercising control over the operation of these components.

As used herein: a "document" is a piece of material, such as a single sheet of paper or a piece of paper separated into a single sheet from an interconnected series of sheets, such as a computer printout; a "Document Entry Device (DED)" is a mechanism that is suitable to eject documents onto a conveyor; a "conveyor" is a mechanism that is suitable to transport documents from one DED to another DED, thus enabling the compilation of related documents into a collation of documents in an orderly manner; a "Single DED (SDED)" is a DED that is suitable to eject a single document at a time onto a conveyor; a "Multiple DED (MDED)" is a DED that is suitable to assemble more than one document as an "enclosure" and to eject the entire enclosure onto the conveyor; and a "collation" is a set of documents and/or enclosures compiled by the cooperative actions of the conveyor and the DEDs.

The proper compilation of documents and/or enclosures into collations on the conveyor requires careful synchronization by the contrioller over the ejection of documents and/or enclosures by the DEDs as well as over the movement of the conveyor. As is well known to one skilled in the art to which this invention pertains, the assembly of an enclosure by an MDED prior to its ejection onto the conveyor may necessitate stopping the conveyor in order to allow the MDED time to assemble the enclosure prior to related documents in the collation arriving at the MDED on the conveyor. After the assembly of the enclosure is completed by the MDED, the conveyor must be restarted to continue the compilation of the collation. This mode of operation is termed the "stop-start" mode.

The "stop-start" mode of operation has a number of undesirable effects on the performance of the inserter system. First and foremost, it is responsible for the majority of jams experienced by the inserter system. Second, it increases mechanical wear on all components affected by the stop-start action. Third, it necessitates more complex synchronization between the DEDs and the conveyor. Fourth, it tends to reduce the inserter system throughput.

DISCLOSURE OF THE INVENTION

It is an object of this invention to provide apparatus for an a method of allowing for continuous (nonstop) operation of the conveyor in an inserter system, thereby avoiding the stop-start mode of operation.

According to the invention, continuous operation of the conveyor in an inserter system is achieved by providing a Lift Up Station (LUS) between a Document Entry Device (DED) and the next downstream Multiple Document Entry Device (MDED). A controller causes the LUS to remove documents ejected by the DED from the conveyor when it is determined that the time interval, $t_2$, required by the MDED to complete assembly of an enclosure for ejection onto the conveyor exceeds the time interval, $t_1$, required by the conveyor to move the document ejected by the DED to the MDED, and subsequently causes the LUS to replace the documents onto the conveyor at a time substantially $t_2-t_1$ later.

According to an aspect of the invention, a LUS is disposed between each adjacent pair of DEDs, at least up to and including the most downstream MDED. The LUS's operate in unison to remove all collations-in-process from the conveyor stream whenever an enclosure will not be ready for ejection by any MDED, and operate in unison to replace all of the collations-in-process back onto the conveyor when the enclosure is complete.

Apparatus and method are disclosed.

Other objects, features and advantages of the invention will become more apparent in light of the following description thereof.

It should be understood that the invention relates mainly to the compilation of related documents into collations by an inserter system.

DETAILED DESCRIPTION OF THE INVENTION

Figure 1:
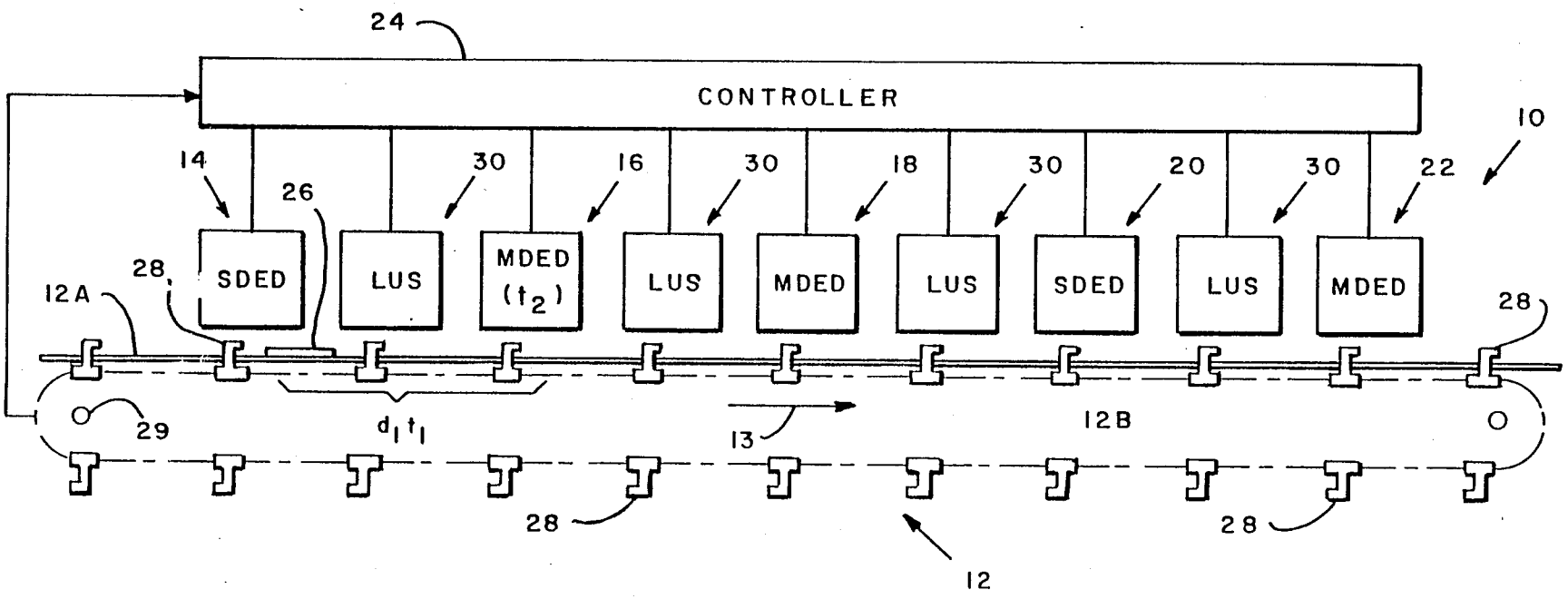
FIG. 1 is a schematic representation of the inserter system of this invention.

FIG. 1 shows an inserter system 10. A conveyor 12 transports documents in a "downstream" direction (from left to right, as shown), as represented by the arrow 13, past a series of document entry devices (DEDs) that eject either a single document or an enclosure of documents onto the conveyor, thereby allowing for the compilation of a related set of documents into a collation of documents. In the example of FIG. 1, the first in the series of DEDs is a Single Document Entry Device (SDED) 14, the second DED is a Multiple Document Entry Device (MDED) 16, the third DED is a MDED 18, the fourth DED is a SDED 20, and the fifth DED is a MDED 22. An electronic controller 24, which is preferably microprocessor-based, is connected to the conveyor 12 to control its motion, and to each of the DEDs 14–22 to control ejection of their respective documents and enclosures. A typical document 26 is shown as having been ejected by the SDED 14 onto the conveyor. The document 26 is advanced by pushers 28 along a paper path 12A defined by the conveyor 12. The pushers 28 are driven by a chain 12B.

Consider the following situation. The conveyor is running and all of the SDEDs and MDEDs have documents or enclosures to be compiled with a particular collation. The document 26 ejected by the SDED 14 is to be compiled with a related enclosure from the MDED 16 when the conveyor has advanced the document a distance, d, into juxtaposition with the MDED 16. At a particular velocity, v, it takes the conveyor a time, $t_1$, to transport the document 26 the distance, d. A suitable sensor, such as an encoder 29, provides conveyor velocity information to the controller.

However, it takes the MDED a time, $t_2$, greater than the time $t_1$, to assemble its enclosure. This situation can be anticipated by the controller which ordinarily would, in response to the anticipation of this situation, stop the conveyor in order to allow time (nominally $t_2-t_1$) for the MDED 16 to complete the assembly of its enclosure, and the restart the conveyor so as to allow for the ejection and compilation of the enclosure onto the document 26.

The requisite anticipation by the controller that $t_2$ is greater than $t_1$ is based on either preprogrammed data relating to the collations, or on information read by the scanners from a "control" document, such as the document 26. The latter technique is disclosed in detail in commonly-owned U.S. Pat. No. 4,527,790 issued to Piotroski in 1985 and entitled APPARATUS AND METHOD FOR SEPARATING MULTIPLE WEBS OF DOCUMENTS HAVING THE CAPACITY FOR ORDERLY SHUT-DOWN AND RE-START OF OPERATION, which is expressly incorporated by reference herein.

A Lift Up Station (LUS) 30 is disposed along the conveyor between the SDED 14 and the MDED 16. The lift up station is capable of removing the document 26 (and, as will be evident hereinafter, a collation or collation-in-process of documents) from the conveyor 12 and replacing it thereon in response to commands by the controller. When it is anticipated by the controller that the MDED 16 cannot assemble its enclosure in a timely manner, in other words $t_2>t_1$, a remove command is issued by the controller to the lift up station 30 so as to remove (divert) the document 26 from the conveyor, without stopping the conveyor. When assembly of the enclosure is completed by the MDED 16, as indicated by the time interval $t_2$ having elapsed or by a signal from a suitable sensor in the MDED 16, a replace command is issued by the controller to the LUS 30, at the proper time with regard to pusher synchronization, to cause the LUS 30 to replace the document 26 onto the conveyor, and the enclosure from the MDED 16 is ejected to compile with the document 26 on the conveyor.

Insofar as pusher synchronization is concerned, it is well known in the art to which this invention pertains that the ejection of documents or enclosures, such as from a DED, onto a moving conveyor must be coordinated by the controller so that the document or enclosure is properly positioned with respect to the "pushers" (typically a plurality of fingers extending from the surface of the conveyor, and evenly-spaced along its length) which actually perform the function of moving the documents along the conveyor paper path 12A.

In a similar manner, a LUS is disposed between the MDED 16 and the MDED 18, a LUS is disposed between the MDED 18 and the SDED 20, and a LUS is disposed between the SDED 20 and a MDED 22 so as to enable nonstop (continuous) operation of the conveyor in cases where a MDED takes longer to assemble an enclosure for the conveyor to transport related documents to it from the previous DED. In this case, all of the LUSs 30 operate in unison to remove the documents and/or collations-in-process from the conveyor stream while the MDED completes its enclosure, and to replace in unison all of the documents and/or collations-in-process back onto the conveyor when the enclosure is completed and ready for ejection by the MDED. An illustrative embodiment of a LUS is provided hereinafter. "Collation-in-process" means any collation of documents, including the first document 26, which have yet to pass by the most downstream DED for addition of a document or enclosure of documents therefrom.

Figure 2:
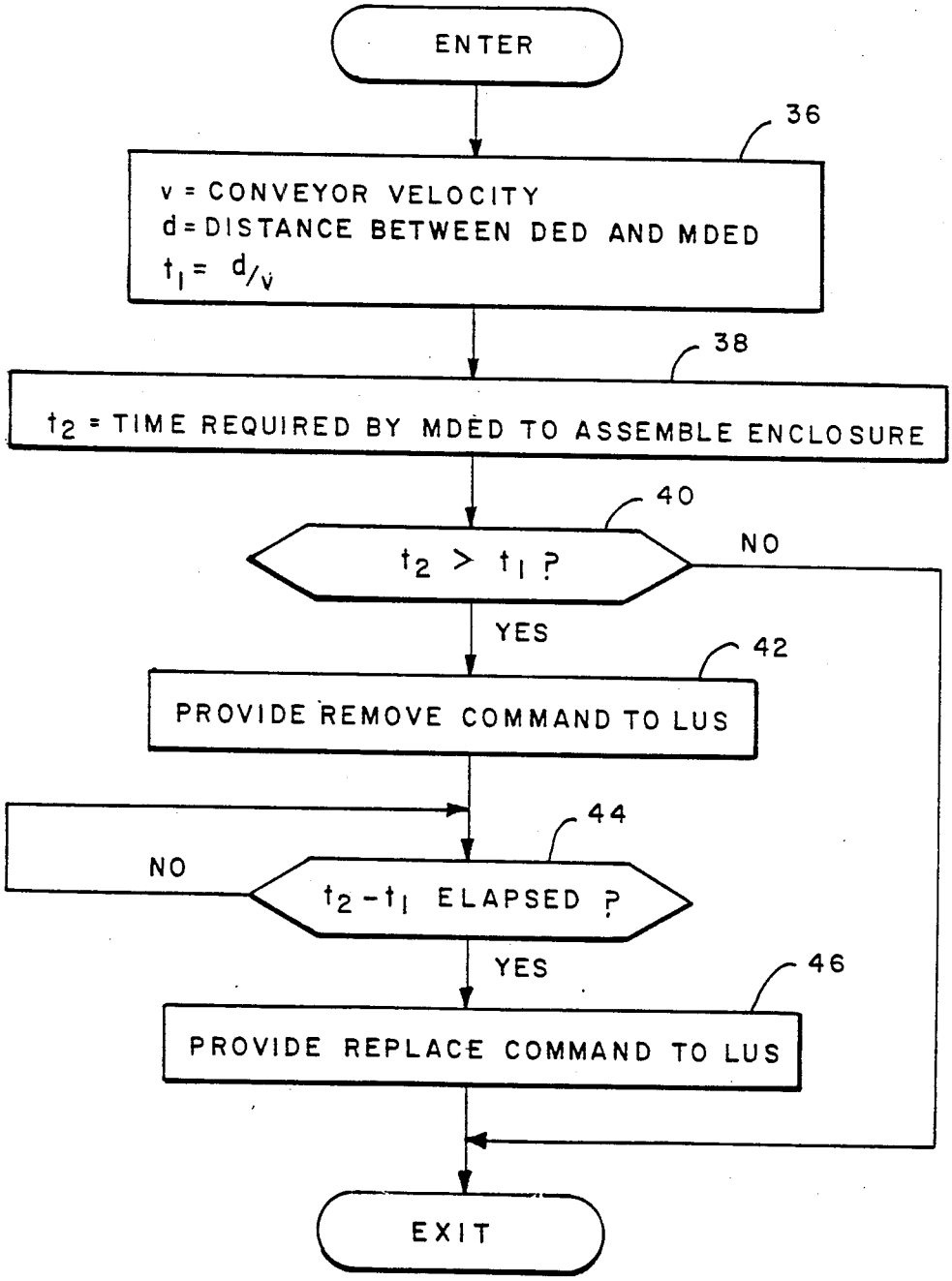
FIG. 2 is a flowchart illustrating the method of this invention, applicable to the inserter system of FIG. 1.

FIG. 2 presents a simplified flowchart to suitably program a microprocessor-based controller or to construct a discrete circuit or mechanism to practice the method of inserter system operation taught herein. In a first step 36, values are determined for the conveyor velocity, v, the distance, d, between each of the MDED's and their respective immediately adjacent upstream DED's, and the time, $t_1$, required for the conveyor to transport a document or documents to each of the MDED's from their respective immediately adjacent upstream DED's. In a step 38, the time, $t_2$, required for each of the MDED's to assemble their enclosures is determined.

Next, in a step 40 it is determined whether $t_2$ exceeds $t_1$ for any of the MDED's. If not, the routine is exited. If so, in a step 42 the controller provides the remove command to all of the LUS's, so as to divert the collations-in-process from the conveyor stream while the conveyor continues running.

Substantially when an interval $t_2-t_1$ has elapsed, as determined in a step 44, the controller issues the replace command in a step 46 so that the collations-in-process will be returned to the conveyor stream.

Figure 3:
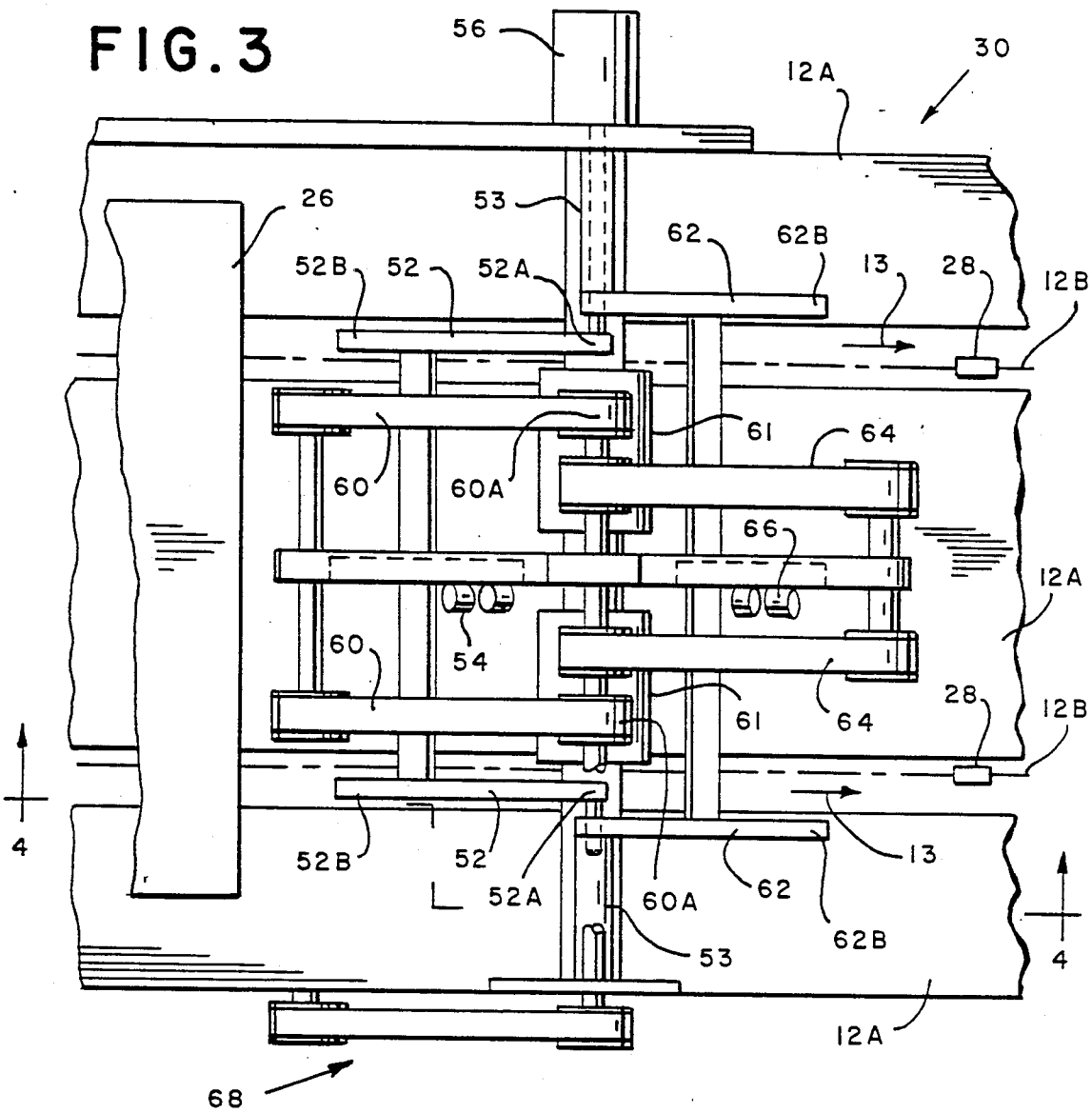
FIG. 3 is a top view schematic diagram of the Lift Up Station of FIG. 3.
Figure 4:
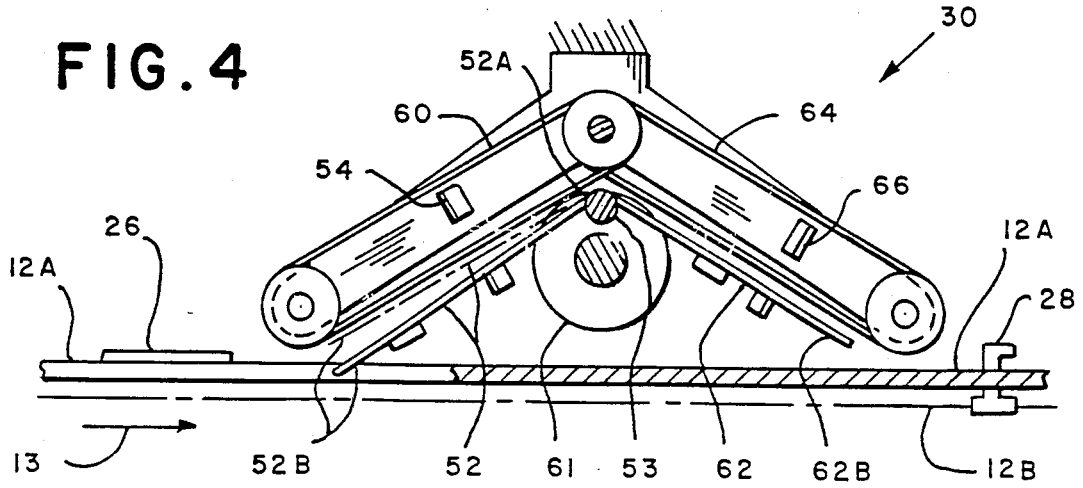
FIG. 4 is a side view schematic diagram of the Lift Up Station suitable for the inserter system of FIG. 1.

FIGS. 3 and 4 show, in top and side views respectively, the LUS 30 of FIG. 1. The Lift-Up Station 30 is positioned just above and straddling the paper path defining surface 12A of the conveyor 12, which is moving in a direction illustrated by the Arrow 13. As shown, a document 26 is approaching the LUS 30.

The LUS 30 has two rigid elongated members 52 pivotably mounted at one end 52A to a stationary pivot point 53 above the surface 12A, and extending counter to the direction of conveyor movement (upstream) therefrom. The members 52 are movable between two positions; an extended position, shown by solid lines, and a retracted position, an extended position, shown by solid lines, and a retracted position, shown by dashed lines in FIG. 3. In the extended position, the movable end 52B of the members 52 extends slightly into the paper path 12A so as to form a "ramp" diverting the document upward into the LUS 30, off of the conveyor. A sensor, such as a photocell 54, is disposed in the LUS 30 at a position along the length of the movable members 52 to detect the advancement of the document 26 up the ramp a suitable distance, such as one-half the document length. When the document reaches that position (as urged along by pushers on the conveyor acting upon the trailing edge of the document), the photocell 54 causes the members 52 to move to their retracted position, via a mechanism 56 thereby completely removing the document 26 from the conveyor surface 12A. In the context of the overall control system described hereinbefore, the members 52 are extended to divert the document from the conveyor paper path 12A in response to the remove command from the controller 24 (of FIG. 1).

The LUS 30 is provided with moving belts that cooperate with the members 52 in their retracted position to advance the document 26 further into the LUS 30. More particularly a pair of belts 60 extend from a point above the pivot point 53, downward along the path defined by the members 52 in their retracted position, to a point sufficiently above the conveyor surface 12A so as not to interfere with the passage of documents thereby (such as when the LUS 30 is not in the process of diverting documents from the conveyor).

An articulated paper path is defined within the LUS 30. A pair of idler rollers 61 is disposed between, and just below the pivoted ends 52A of the members 52, a stationary pair of rigid elongated members 62 are disposed in end-to-end relationship with the pivoted ends 52A of the movable members, and extend from the pivot point 53 downward, in the direction of conveyor travel (upstream), towards the surface 12A of the conveyor.

Similarly, a second pair of belts 64 are disposed in overlapping end-to-end relationship with the upper ends 60A of the first pair of belts 60, and extend downward along the path defined by the stationary members 62. A sensor, such as a photocell 66, is disposed in the LUS 30 at a position along the length of the stationary members 62 to detect the advancement of the document 26 nearly to the downstream ends 62B of the members 62. When the document reaches that position, as urged along by the cooperative action of the belts 64, the belts 60 and 64 stop moving. The document would thus be appropriately positioned for quick return to the conveyor stream. Motive power for the belts 60 and 64 is provided by a mechanism 68.

After an appropriate hiatus, nominally $t_2-t_1$ as discussed hereinbefore, the document 26 should be replaced onto the conveyor stream. In response to the replace command from the controller 24, the belts are restarted and eject the document 26 from the downstream ends 62B of the members 62 onto the conveyor, downstream of the LUS 50, and in front of the appropriate set of conveyor pushers (not shown).

What is claimed is:

1. An inserter system comprising:

conveyor means for transporting documents at a velocity, v, in a downstream direction;

document entry device means disposed at a position along the conveyor means for ejecting document(s) onto the conveyor means;

multiple document entry drive means disposed at a position along the conveyor means a distance, d, downstream from the document entry device means for assembling a set of documents into an enclosure and ejecting the enclosure onto the conveyor means so as to compile with the document(s) ejected by the document entry device;

lift up station means disposed at a position along the conveyor means between the document entry device and the multiple document entry device for removing documents from the conveyor means in response to a remove command and for replacing documents onto the conveyor means in response to a replace command; and controller means responsive to the movement of the conveyor means for providing the remove command when the time, $t_2$, required by the multiple document entry device means to assemble an enclosure exceeds the time, $t_1$, required by the conveyor means to transport the document(s) ejected by the document entry device means the distance, d, at the velocity, v.

2. Apparatus according to claim 1 wherein the controller means provides the replace command at a time substantially $t_2-t_1$ after providing the remove command.

3. Apparatus according to claim 1:

wherein there are a total of at least three document entry devices including at least one multiple document entry device;

wherein lift up station means are disposed between each pair of adjacent document entry devices; and wherein the lift up station means operate in unison to remove and replace documents from the conveyor means.

4. A lift up station for removing a document from and replacing a document onto the paper path defining surface (12A) of a moving conveyor (12), comprising:

at least one rigid elongated member (52) pivotally mounted at one end thereof (52A) to a stationary pivot point (53) above the conveyor surface (12A), the upstream end (42B) thereof being free to move between a retracted position and an extended position;

at least one belt (60) extending from a point just above the pivot point (53) along a paper path defined by the at least one member (52) in its retracted position;

wherein in the extended position (42), the upstream end (42B) of the at least one rigid elongated member extends into the paper path of the conveyor to receive the leading edge of a document (26) moving among the conveyor and cause the document to be removed from the conveyor flow into the lift up station;

means (54) for sensing the occurrence of the document having advanced a predetermined distance along the at least one rigid elongated member and for causing the at least one rigid elongated member to move from its extended position to its retracted positon in response to the sensing of the occurrence;

wherein when the at least one rigid elongated member is in the retracted position, the paper path defining surface of the at least one belt cooperates therewith by moving in a direction to urge the document entirely into the lift up station and completely out of the paper path of the conveyor;

second at least one rigid elongated member (62) disposed in a stationary manner in end-to-end relation with the first at least one rigid elongated member (52), having one end thereof in juxtaposition with the one end (52A) of the first at least one rigid elongated member (52), having a downstream end (62B), extending in a downstream direction towards the conveyor paper path (12A) and having a paper path defining surface contiguous with the paper path defining surface of the first at least one rigid elongated member, and defining an extended portion of the paper path within the lift up station;

second at least one belt (64) disposed in end-to-end relation with the first at least one belt (60), and extending along the paper path defined by the second at least one rigid elongated member (62); and means (66) for sensing the occurrence of the leading edge of the document (26) being nearly to the downstream end (62B) of the second at least one rigid elongated member (62), and for causing the motion of the first and second at least one belts to cease in response to the sensing of the occurrence.

5. Apparatus according to claim 4 further comprising means (24) for restarting the motion of the second at least one belt so as to cause a document in the lift up station to be replaced onto the conveyor paper path (12A) downstream of the lift up station.

* * * * *